US007881035B2

(12) United States Patent
Takahashi et al.

(10) Patent No.: US 7,881,035 B2
(45) Date of Patent: Feb. 1, 2011

(54) HIGH-PRESSURE FUEL PUMP DRIVE CIRCUIT FOR ENGINE

(75) Inventors: Nobuyuki Takahashi, Hitachinaka (JP); Takashi Okamoto, Hitachinaka (JP); Takuya Mayuzumi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 429 days.

(21) Appl. No.: 11/833,677

(22) Filed: Aug. 3, 2007

(65) Prior Publication Data

US 2008/0030917 A1 Feb. 7, 2008

(30) Foreign Application Priority Data

Aug. 4, 2006 (JP) ..... 2006-213760

(51) Int. Cl.
*H01H 9/00* (2006.01)

(52) U.S. Cl. ..... 361/152; 361/160

(58) Field of Classification Search ..... 361/139, 361/152, 159, 160

See application file for complete search history.

(56) References Cited

U.S. PATENT DOCUMENTS 5,012,381 A * 4/1991 Elliott et al. ..... 361/84
6,369,533 B1 * 4/2002 Mourad et al. ..... 318/400.21
6,934,140 B1 * 8/2005 Rober et al. ..... 361/154
7,433,171 B2 * 10/2008 Vincent et al. ..... 361/159
2004/0212944 A1 10/2004 Tanzawa et al.

FOREIGN PATENT DOCUMENTS

JP 8-55720 A 2/1996
JP 2002-237412 A 8/2002

OTHER PUBLICATIONS

Watanabe, "Practical Method for the Design of Analog Electronic Circuit" Sogo denshi Press 1996 w Partial English Translation.

* cited by examiner

*Primary Examiner*—Danny Nguyen
(74) *Attorney, Agent, or Firm*—Crowell & Moring LLP

(57) ABSTRACT

There is provided a high-pressure fuel pump drive circuit for manipulating the electric current to be passed to a solenoid coil for controlling a high-pressure pump. This circuit is characterized in that a first switching element, the solenoid coil and a second switching element are connected in series with each other in a rout from a source voltage side to the ground side, that a flywheel diode for passing electric current to a power source is disposed parallel with the solenoid and with the first switching element, and that a Zener diode connected with the power source is disposed parallel with the second switching element, wherein a counter electromotive force to be developed at the opposite ends of solenoid coil on the occasion when the second switching element is changed from ON to OFF is consumed by the flywheel diode provided that the first switching element is in a state of ON, and the counter electromotive force is more rapidly consumed by the Zener diode provided that the first switching element is turned OFF.

14 Claims, 6 Drawing Sheets

HIGH-PRESSURE FUEL PUMP DRIVE CIRCUIT FOR ENGINE

BACKGROUND OF THE INVENTION

The present invention relates to a high-pressure fuel pump drive circuit which is designed to control electric current on the occasion of driving a high-pressure fuel pump for engine so as to decrease the fall time of electric current flowing into the load having inductance.

Prior arts to the present invention are disclosed, for example, in JP Published Patent Application 2002-237412 A, JP Published Patent Application H8-55720 A and Watanabe "Practical Method for the Design of Analog Electronic Circuit" Sogo denshi Press 1996.

FIG. 1 illustrates a conventional circuit configuration of a high-pressure fuel pump drive circuit for engine. In this circuit, the solenoid coil 2 of high-pressure fuel pump is connected with the drain of switching MOSFET (Nch) 3 and furthermore, the cathode of a flywheel diode 1 is connected with a source voltage VB and the anode of the flywheel diode 1 is connected with the solenoid coil 2. When an input voltage is applied to the gate of MOSFET (Nch) 3, the MOSFET (Nch) 3 is turned ON, permitting an electric current IL to pass to the solenoid coil 2. At this moment, the drain voltage VD of MOSFET (Nch) 3 is caused to drop from VB to about 0 volt and, at the same time, the electric current IL passing through the solenoid coil 2 is caused to rise transiently and electromagnetic energy is caused to accumulate in the solenoid coil 2 due to this electric current IL.

When the input voltage to the gate of MOSFET (Nch) 3 is dropped to 0 volt, a power to force electric current to flow in the direction to inhibit any changes of magnetic flux is acted thereon due to the self-induction electromotive force ($e=L*\Delta I/\Delta t$) by the electromagnetic energy. As a result, the electric potential of VD is caused to rise, whereby large voltages, opposite in direction, are imposed on the opposite ends of the solenoid coil 2, respectively. These large voltages developed on the opposite ends of the solenoid coil 2 can be vanished by passing electric current to the flywheel diode 1 which is connected, in parallel, with the solenoid coil 2.

Meanwhile, in a steady state wherein the MOSFET (Nch) 3 is turned ON and an input voltage as indicated by the number 5 in FIG. 2 is given thereto, since the time for shifting the MOSFET (Nch) 3 from OFF to ON can be made shorter as the switching cycle is made faster, the magnitude of voltage to be developed at the opposite ends of solenoid coil 2 can be confined to a small value and, at the same time, the magnitude of energy to be consumed by the flywheel diode 1 can be minimized, thereby making it possible to minimize the generation of heat in the device.

Whereas, when the MOSFET (Nch) 3 is kept in a state of OFF for a relatively long time as indicated by the number 6 in FIG. 2, the electric current to be fed to the solenoid coil 2 having inductance would become zero, thereby permitting an induced electromotive force to generate due to the decrease of the magnetic flux of solenoid coil 2. As a result, an electric current ID is permitted to pass through the flywheel diode 1. In conformity with the decrease of the induced electromotive force, this electric current ID becomes zero after a predetermined period of time though it is accompanied with a relatively long time constant. Namely, the fall time of this electric current ID to be passed to the solenoid coil 2 would be prolonged. As long as this condition is kept unchanged, the controllability of high-pressure fuel pump would be deteriorated and hence the fuel pressure cannot be stabilized. Further, when the rotational speed of engine is increased, there are many possibilities that unintentional behavior of fuel pressure may be caused to occur. Therefore, it may be required to employ a Zener diode in order to shorten the fall time of electric current.

FIG. 3 illustrates another conventional circuit configuration wherein a Zener diode is additionally provided. This circuit configuration differs from that of FIG. 1 in the respects that the cathode of Zener diode 8 is connected with the solenoid coil 7 and the anode of Zener diode 8 is connected with the ground GND, and, additionally, the switching MOSFET (Nch) 9 is connected, in parallel, with the Zener diode 8, thus omitting the flywheel diode. Because, if the flywheel diode is kept unremoved, it would make the Zener diode quite inoperative, thereby rendering the circuit configuration of FIG. 3 the same in function as that of the conventional circuit configuration shown in FIG. 1.

When the switching of steady sate wherein an input voltage as indicated by the number 5 in FIG. 2 is impressed is applied to the MOSFET (Nch) 9, the electric current would be clamped by the Zener diode 8 every occasion the MOSFET (Nch) 9 is turned OFF, thereby rendering the Zener diode 8 to generate such a large magnitude of heat that the device can no longer withstand the heat thus generated.

Therefore, it is required to shorten the fall time of electric current flowing into the solenoid coil and also to suppress the generation of heat from the device.

BRIEF SUMMARY OF THE INVENTION

The present invention has been accomplished with a view to overcome the aforementioned problems and, therefore, the present invention provides a high-pressure fuel pump drive circuit which is a circuit for manipulating the electric current to be passed to a solenoid coil for controlling a high-pressure pump, this high-pressure fuel pump drive circuit being characterized in that a first switching element, the solenoid coil and a second switching element are connected in series with each other in a rout from a source voltage side to the ground side, that a flywheel diode for passing electric current to a power source is disposed parallel with the solenoid and with the first switching element, and that a Zener diode connected with the power source is disposed parallel with the second switching element, wherein a counter electromotive force to be developed at the opposite ends of solenoid coil on the occasion when the second switching element is changed from ON to OFF is consumed by the flywheel diode provided that the first switching element is in a state of ON, and the counter electromotive force is more rapidly consumed by the Zener diode provided that the first switching element is turned OFF.

Further, the present invention also provides a high-pressure fuel pump drive circuit which is a circuit for manipulating the electric current to be passed to a solenoid coil for controlling a high-pressure pump, this high-pressure fuel pump drive circuit being characterized in that a first switching element, the solenoid coil and a second switching element are connected in series with each other in a rout from a source voltage side to the ground side, that a flywheel diode for passing electric current to the first switching element to the ground is disposed parallel with the second switching element and with the solenoid, and that a Zener diode connecting the ground with the solenoid is disposed parallel with the second switching element, wherein a counter electromotive force to be developed at the opposite ends of solenoid coil on the occasion when the first switching element is changed from ON to OFF is consumed by the flywheel diode provided that the second switching element is in a state of ON, and the counter electromotive force is more rapidly consumed by the Zener diode provided that the second switching element is turned OFF.

Further, the present invention also provides a high-pressure fuel pump drive circuit which is a circuit for manipulating the electric current to be passed to a solenoid coil for controlling a high-pressure pump, this high-pressure fuel pump drive circuit being characterized in that the solenoid coil and a second switching element are connected in series with each other in a rout from a source voltage side to the ground side, that a flywheel diode for passing electric current to a power source is disposed in series with the first switching element and in parallel with the solenoid, and that a Zener diode connected with the power source is disposed parallel with the first switching element, wherein a counter electromotive force to be developed at the opposite ends of solenoid coil on the occasion when the second switching element is changed from ON to OFF is consumed by the flywheel diode provided that the first switching element is in a state of ON, and the counter electromotive force is more rapidly consumed by the Zener diode provided that the first switching element is turned OFF.

Further, the present invention also provides a high-pressure fuel pump drive circuit which is a circuit for manipulating the electric current to be passed to a solenoid coil for controlling a high-pressure pump, this high-pressure fuel pump drive circuit being characterized in that a first switching element and the solenoid coil are connected in series with each other in a rout from a source voltage side to the ground side, that a second switching element for passing electric current from the ground side to the first switching element is disposed in series with the flywheel diode and in parallel with the solenoid, and that a Zener diode connecting the ground with the flywheel diode is disposed parallel with the second switching element, wherein a counter electromotive force to be developed at the opposite ends of solenoid coil on the occasion when the first switching element is changed from ON to OFF is consumed by the flywheel diode provided that the second switching element is in a state of ON, and the counter electromotive force is more rapidly consumed by the Zener diode provided that the second switching element is turned OFF.

Further, the present invention also provides a high-pressure fuel pump drive circuit which is a circuit for manipulating the electric current to be passed to a solenoid coil for controlling a high-pressure pump, this high-pressure fuel pump drive circuit being characterized in that a first switching element, the solenoid coil and a second switching element are connected in series with each other in a rout from a source voltage side to the ground side, that a flywheel diode for passing electric current from the ground side is disposed parallel with the solenoid and with the second switching element, and that a diode for passing electric current from the second switching element of solenoid to a boosting electrolytic capacitor is disposed, wherein a counter electromotive force to be developed at the opposite ends of solenoid coil on the occasion when the first switching element is changed from ON to OFF is consumed by the flywheel diode provided that the second switching element is in a state of ON, and the counter electromotive force is more rapidly consumed by the diode and the booster electrolytic capacitor provided that the second switching element is turned OFF.

Additionally, the present invention also provides a high-pressure fuel pump drive circuit which can be obtained by modifying the structure of the aforementioned high-pressure fuel pump drive circuit in such a manner that the Zener diode is omitted and that the switching element disposed parallel with the Zener diode is replaced by a clamp Zener diode-attached IPD, thus obtaining almost the same effects as obtainable in the aforementioned high-pressure fuel pump drive circuit.

Likewise, the present invention also provides a high-pressure fuel pump drive circuit which can be obtained by modifying the structure of the aforementioned high-pressure fuel pump drive circuit in such a manner that the switching element disposed parallel with the Zener diode is additionally provided with a current-detecting circuit.

According to the present invention, it is possible to secure a steady state subsequent to the build-up of electric current inflow and to perform, during the entire period of this steady state, current feedback by means of flywheel diode which makes it possible to save the consumption of energy. On the occasion of falling the electric current, a Zener diode is employed for enabling the energy to be instantaneously consumed, thereby accelerating the fall time of electric current flowing into the solenoid coil of the high-pressure pump, thus suppressing the generation of heat in the device.

DETAILED DESCRIPTION OF THE INVENTION

Next, specific embodiments of the present invention will be explained with reference to drawings.

EXAMPLE 1

Figure 4:
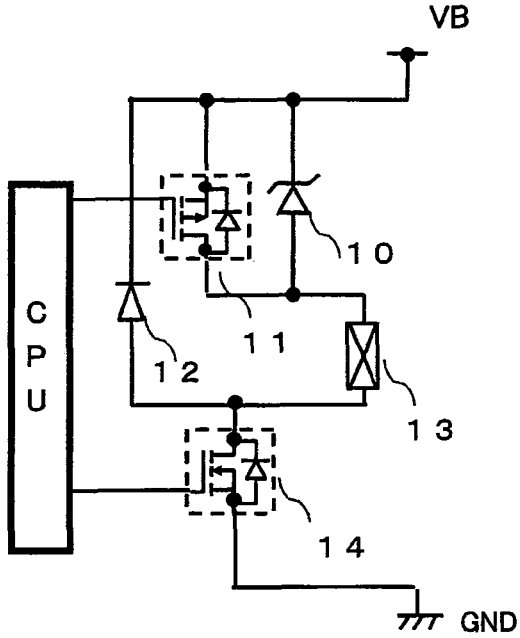
FIG. 4 is a diagram illustrating a circuit configuration of a high-pressure fuel pump drive circuit for engine according to Example 1.

FIG. 4 illustrates a circuit configuration of a high-pressure fuel pump drive circuit for engine according to Example 1.

In this circuit, the solenoid 13 of high-pressure pump is connected with the drain of switching MOSFET (Nch) 14, and the cathode of flywheel diode 12 is connected with the source voltage VB and the anode of flywheel diode 12 is connected with the solenoid. Further, the cathode of Zener diode 10 is connected with the VB and the anode thereof is connected with the solenoid coil. The MOSFET (Pch) 11 is connected, in parallel, with the Zener diode. When an input voltage is impressed to the gates of the MOSFET (Pch) 11 and the MOSFET (Nch) 14, not only the MOSFET (Pch) 11 but also the MOSFET (Nch) 14 is turned ON, permitting an electric current IL to flow into the solenoid coil 13. At this moment, the drain voltage VD of MOSFET (Nch) 14 is caused to fall from the VB to about zero volt and, at the same time, the electric current IL flowing through the solenoid coil 13 is caused to rise transiently and electromagnetic energy is caused to accumulate in the solenoid coil 13 due to this electric current IL.

When the gate voltage of the MOSFET (Nch) 14 is dropped to 0 volt, a power to force electric current to flow in the direction to inhibit any changes of magnetic flux is acted thereon due to the self-induction electromotive force ($e=L*\Delta I/\Delta t$) by the electromagnetic energy, thus raising the electric potential of the VD. Namely, large voltages, opposite in direction, are imposed on the opposite ends of the solenoid coil 13, respectively. These large voltages developed on the opposite ends of the solenoid coil 13 can be vanished by passing electric current to the flywheel diode 12 which is connected, in parallel, with the solenoid coil 13.

Figure 2:
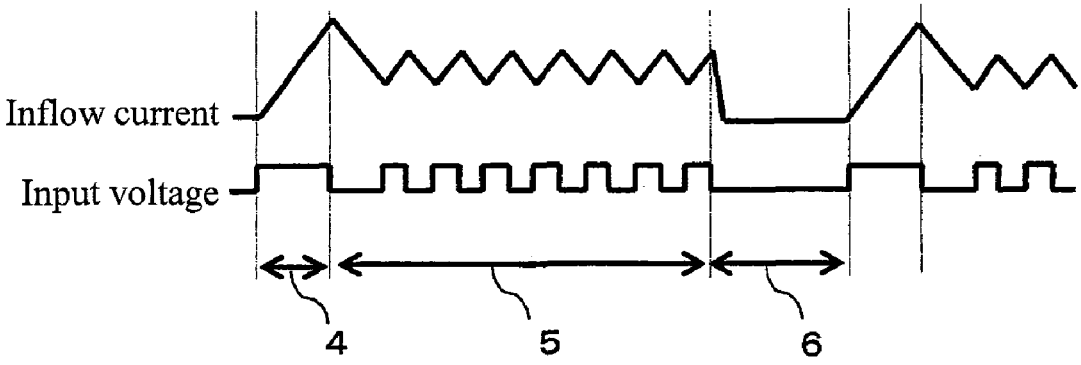
FIG. 2 is a diagram illustrating a representative waveform of input voltage and a representative waveform of inflow current in a high-pressure fuel pump drive circuit for engine.

Meanwhile, in a steady state wherein the MOSFET (Nch) 14 is turned ON and an input voltage as indicated by the number 5 in FIG. 2 is given thereto, since the time for shifting the MOSFET (Nch) 14 from OFF to ON can be made shorter as the switching cycle is made faster, the magnitude of voltage to be developed at the opposite ends of solenoid coil 13 can be confined to a small value and, at the same time, the magnitude of energy to be consumed by the flywheel diode 12 can be minimized, thereby making it possible to minimize the generation of heat in the device.

Figure 1:
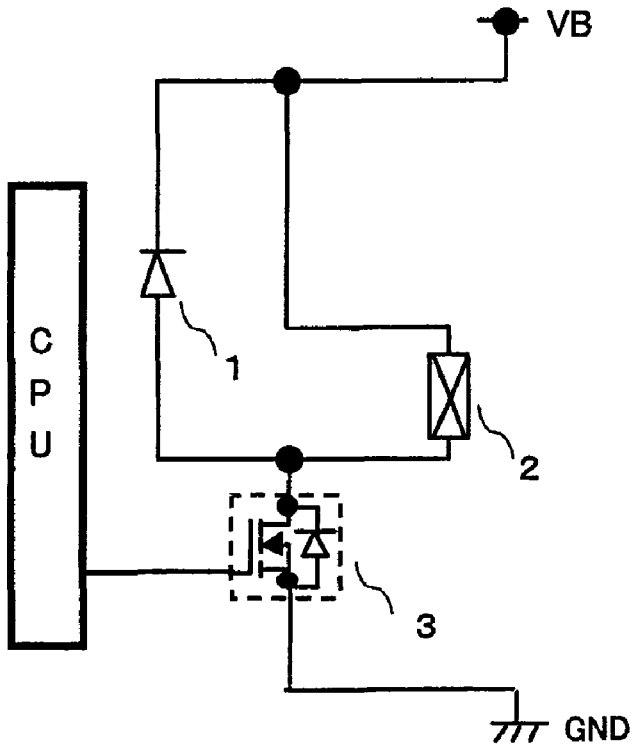
FIG. 1 is a diagram illustrating a conventional circuit configuration of a high-pressure fuel pump drive circuit for engine.
Figure 3:
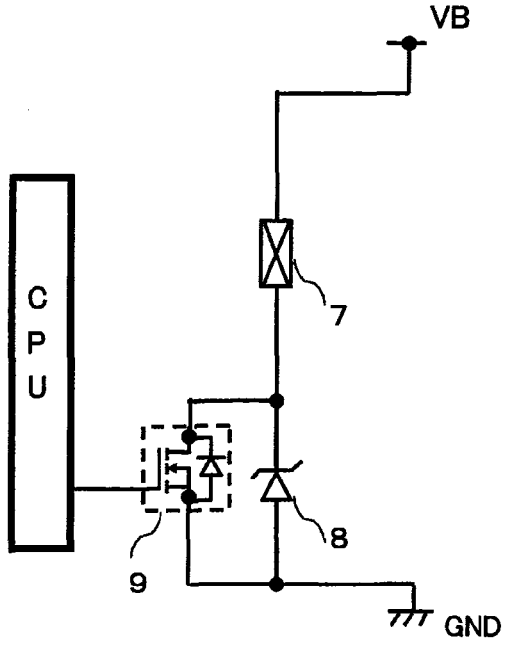
FIG. 3 is a diagram illustrating a conventional circuit configuration of a high-pressure fuel pump drive circuit for engine, wherein a Zener diode is additionally incorporated.
Figure 5:
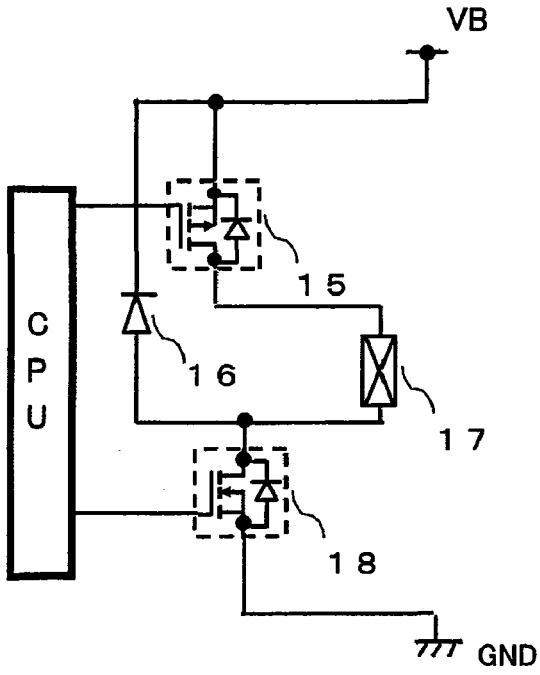
FIG. 5 is a diagram illustrating a circuit configuration modified of the high-pressure fuel pump drive circuit for engine according to Example 1.

The configuration of circuit described above is the same as that of the conventional circuit shown in FIG. 1. However, the circuit of this example is additionally provided with the following features. Namely, in order to accelerate the fall time of electric current, when the switching MOSFET (Nch) 14 is turned OFF, the MOSFET (Pch) 11 is also concurrently turned OFF. When the gate voltage of MOSFET (Pch) 11 and of MOSFET (Nch) 14 is decreased to zero volt, a power to force electric current to flow in the direction to inhibit any changes of magnetic flux is acted thereon due to the self-induction electromotive force ($e=L*\Delta I/\Delta t$) by the electromagnetic energy, whereby the electric potential of VD is caused to rise, thus imposing a large voltage on the opposite ends of Zener diode 10. This large voltage developed on the opposite ends of Zener diode 10 cannot be consumed by the flywheel diode 12 due to the existence of the Zener diode 10 but can be completely consumed by the Zener diode. Because of this, it is possible to further shorten the fall time of electric current as compared with the conventional circuit configuration shown in FIG. 1. Furthermore, in contrast to the circuit of FIG. 3, the consumption of energy by the Zener diode 10 cannot be executed unless the switching MOSFET (Pch) 11 is turned OFF even if the MOSFET (Nch) 14 is switched, thus making it possible to suppress the generation of heat in the device. If saving of cost is taken into consideration, it may be advisable to employ a clamp Zener diode-attached IPD 15 as shown in FIG. 5 instead of singly employing the Zener diode 10, thereby making it possible to suppress the manufacturing cost.

In the case of the circuit configuration as described above, even if the solenoid coils 13, 17 are brought into short-circuiting with VB, it is possible to protect the circuit by the switching of the MOSFETs (Nch) 14, 18 to OFF. On the contrary, when the solenoid coils 13, 17 are brought into short-circuiting with GND, it is possible to protect the circuit by the switching of the MOSFET (Pch) 11 and the clamp Zener diode-attached IPD 15 to OFF. Further, when the opposite ends of solenoid coils 13, 17 are brought into short-circuiting due to harness, it is possible to detect the abnormality of electric current by changing the MOSFETs (Nch) 14, 18 into an over-current protection function-attached (Nch) IPD, respectively. Further, although it may become more expensive, a current-detecting circuit may be additionally attached to the aforementioned circuit configuration without changing the MOSFETs (Nch) 14, 18 into the IPD, respectively, thereby making it possible to detect the abnormality of electric current and also to improve the accuracy of electric current flowing into the solenoid coils.

EXAMPLE 2

Figure 6:
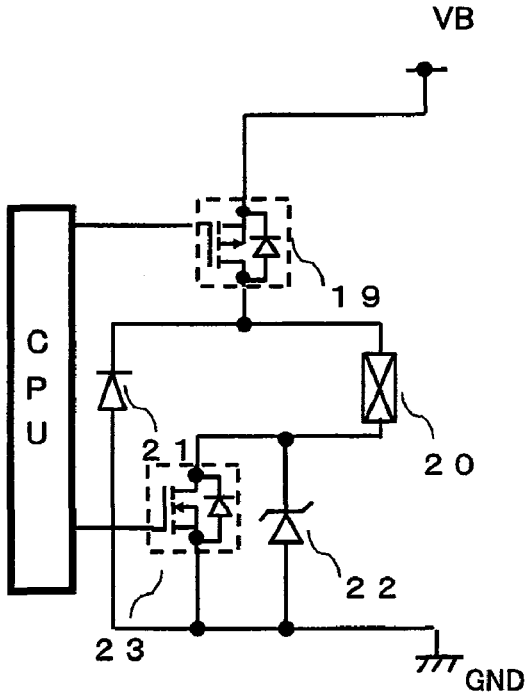
FIG. 6 is a diagram illustrating a circuit configuration of a high-pressure fuel pump drive circuit for engine according to Example 2.

FIG. 6 illustrates a circuit configuration of a high-pressure fuel pump drive circuit for engine according to Example 2.

In this circuit, the solenoid coil 20 of high-pressure pump is connected with the drain of switching MOSFET (Pch) 19, and the cathode of flywheel diode 21 is connected with the drain of switching MOSFET (Pch) 19 and the anode of flywheel diode 21 is connected with the GND. Further, the cathode of Zener diode 22 is connected with the solenoid coil 20 and the anode thereof is connected with the GND. The MOSFET (Nch) 23 is connected, in parallel, with the Zener diode.

When an input voltage is impressed to the MOSFET (Pch) 19 and the MOSFET (Nch) 23, not only the MOSFET (Pch) 19 but also the MOSFET (Nch) 23 is turned ON, permitting an electric current IL to flow into the solenoid coil 20. At this moment, the drain voltage VD of MOSFET (Pch) 19 is caused to fall from the source voltage VB to about zero volt and, at the same time, the electric current IL flowing through the solenoid coil 20 is caused to rise transiently and electromagnetic energy is caused to accumulate in the solenoid coil 20 due to this electric current IL. When the gate voltage of the MOSFET (Pch) 19 is dropped to 0 volt, a power to force electric current to flow in the direction to inhibit any changes of magnetic flux is acted thereon due to the self-induction electromotive force ($e=L*\Delta I/\Delta t$) by the electromagnetic energy, thereby causing the electric potential of VD to rise. Namely, large voltages, opposite in direction, are imposed on the opposite ends of the solenoid coil 20, respectively. These large voltages developed on the opposite ends of the solenoid coil 20 can be vanished by passing electric current to the flywheel diode 21 which is connected, in parallel, with the solenoid coil 20.

Meanwhile, in a steady state wherein the MOSFET (Pch) 19 is turned ON and an input signal as indicated by the number 5 in FIG. 2 is given thereto, since the time for shifting the MOSFET (Pch) 19 from OFF to ON can be made shorter as the switching cycle is made faster, the magnitude of voltage to be developed at the opposite ends of solenoid coil 20 can be confined to a small value and, at the same time, the magnitude of energy to be consumed by the flywheel diode 21 can be minimized, thereby making it possible to minimize the generation of heat in the device.

Figure 7:
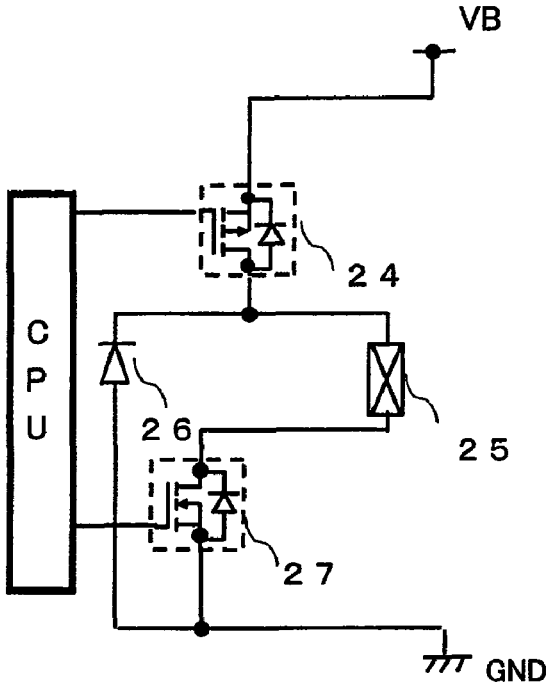
FIG. 7 is a diagram illustrating a circuit configuration modified of the high-pressure fuel pump drive circuit for engine according to Example 2.

When the MOSFET (Pch) 19 is turned OFF concurrent with the switching of the switching MOSFET (Nch) 23 to OFF in order to accelerate the fall time of electric current, a power to force electric current to flow in the direction to inhibit any changes of magnetic flux is acted thereon due to the self-induction electromotive force ($e=L*\Delta I/\Delta t$) by the electromagnetic energy, whereby the electric potential of VD is caused to rise, thus imposing a large voltage on the opposite ends of Zener diode 22. This large voltage developed on the opposite ends of Zener diode 22 cannot be consumed by the flywheel diode 21 due to the existence of the Zener diode 22 but can be completely consumed by the Zener diode. Because of this, it is possible to further shorten the fall time of electric current as compared with the conventional circuit configuration shown in FIG. 1. Furthermore, in contrast to the circuit of FIG. 3, the consumption of energy by the Zener diode 22 cannot be executed unless the switching MOSFET (Nch) 23 is turned OFF even if the MOSFET (Pch) 19 is switched, thus making it possible to suppress the generation of heat in the device. If saving of cost is taken into consideration, it may be advisable to employ a clamp Zener diode-attached IPD 27 as shown in FIG. 7 instead of singly employing the Zener diode 22, thereby making it possible to suppress the manufacturing cost.

In the case of the circuit configuration as described above, it is possible to protect the circuit by the switching of the MOSFET (Nch) 23 and the clamp Zener diode-attached IPD 27 to OFF when the solenoid coils 20, 25 are brought into short-circuiting with VB. Further, it is possible to protect the circuit by the switching of the MOSFETs (Pch) 19, 24 to OFF when the solenoid coils 20, 25 are brought into short-circuiting with the GND. Furthermore, when the opposite ends of solenoid coils 20, 25 are brought into short-circuiting due to harness, it is possible to detect the abnormality of electric current by changing the MOSFETs (Pch) 19, 24 into an over-current protection function-attached (Pch) IPD. Further, although it may become more expensive, a current-detecting circuit may be additionally attached to the aforementioned circuit configuration without changing the MOSFETs (Pch) 19, 24 into the IPD, thereby making it possible to detect the abnormality of electric current and also to improve the accuracy of electric current flowing into the solenoid coils 20, 25.

EXAMPLE 3

Figure 8:
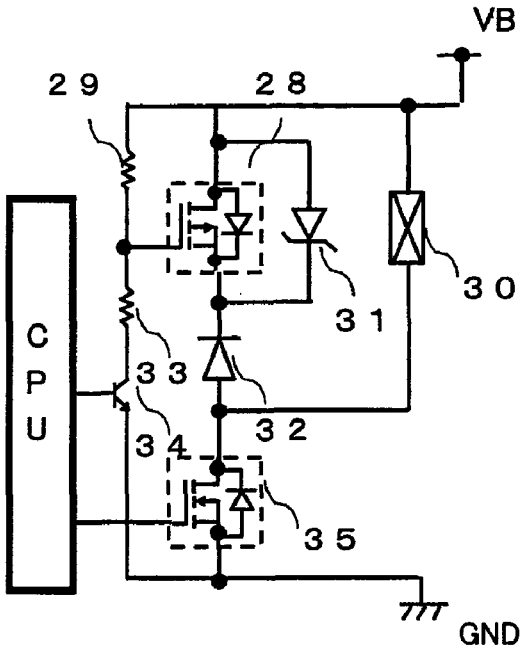
FIG. 8 is a diagram illustrating a circuit configuration of a high-pressure fuel pump drive circuit for engine according to Example 3.

FIG. 8 illustrates a circuit configuration of a high-pressure fuel pump drive circuit for engine according to Example 3.

In this circuit, the solenoid coil 30 of high-pressure pump is connected with the drain of switching MOSFET (Nch) 35, and the anode of flywheel diode 32 is connected with the drain of MOSFET (Nch) 35 and the cathode of flywheel diode 32 is connected with the source of MOSFET (Pch) 28. Further, the anode of Zener diode 31 is connected with the source voltage VB and the cathode thereof is connected with the cathode of flywheel diode 32. The MOSFET (Pch) 28 is connected, in parallel, with the Zener diode. When an input voltage is impressed to the gates of the MOSFET (Pch) 28 and the MOSFET (Nch) 35, not only the MOSFET (Pch) 28 but also the MOSFET (Nch) 35 is turned ON, permitting an electric current IL to flow into the solenoid coil 30. At this moment, the drain voltage VD of MOSFET (Nch) 35 is caused to fall from the VB to about zero volt and, at the same time, the electric current IL flowing through the solenoid coil 30 is caused to rise transiently and electromagnetic energy is caused to accumulate in the solenoid coil 30 due to this electric current IL.

When the gate voltage of the MOSFET (Nch) 35 is dropped to 0 volt, a power to force electric current to flow in the direction to inhibit any changes of magnetic flux is acted thereon due to the self-induction electromotive force ($e=L*\Delta I/\Delta t$) by the electromagnetic energy, thus raising the electric potential of the VD. Namely, large voltages, opposite in direction, are imposed on the opposite ends of the solenoid coil 30, respectively. These large voltages developed on the opposite ends of the solenoid coil 30 can be vanished by passing electric current to the flywheel diode 32 which is connected, in parallel, with the solenoid coil 30.

Meanwhile, in a steady state wherein the MOSFET (Nch) 35 is turned ON and an input voltage as indicated by the number 5 in FIG. 2 is given thereto, since the time for shifting the MOSFET (Nch) 35 from OFF to ON can be made shorter as the switching cycle is made faster, the magnitude of voltage to be developed at the opposite ends of solenoid coil 30 can be confined to a small value and, at the same time, the magnitude of energy to be consumed by the flywheel diode 32 can be minimized, thereby making it possible to minimize the generation of heat in the device.

Figure 9:
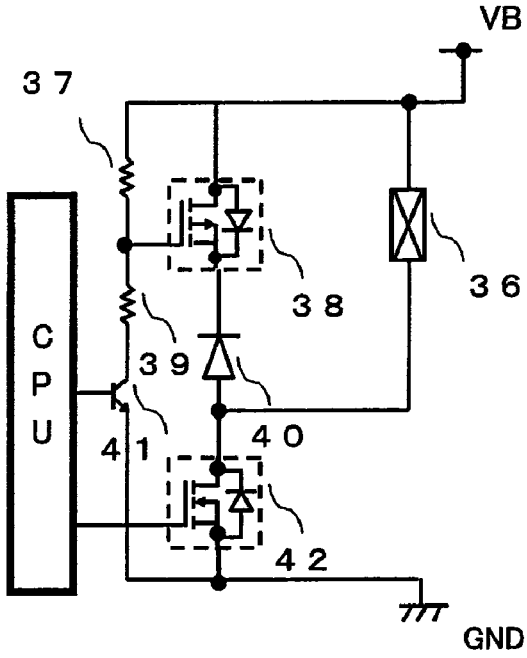
FIG. 9 is a diagram illustrating a circuit configuration modified of the high-pressure fuel pump drive circuit for engine according to Example 3.

When the MOSFET (Pch) 28 is turned OFF concurrent with the switching of switching MOSFET (Nch) 35 to OFF in order to accelerate the fall time of electric current, the gate voltage of MOSFET (Pch) 28 and of MOSFET (Nch) 35 is dropped to zero volt, so that a power to force electric current to flow in the direction to inhibit any changes of magnetic flux is acted thereon due to the self-induction electromotive force ($e=L*\Delta I/\Delta t$) by the electromagnetic energy, whereby the electric potential of VD is caused to rise, thus imposing a large voltage on the opposite ends of Zener diode 31. This large voltage developed on the opposite ends of Zener diode 31 cannot be consumed by the flywheel diode 32 due to the existence of the Zener diode 31 but can be completely consumed by the Zener diode. Because of this, it is possible to further shorten the fall time of electric current as compared with the conventional circuit configuration shown in FIG. 1. Furthermore, in contrast to the circuit of FIG. 3, the consumption of energy by the Zener diode 31 cannot be executed unless the switching MOSFET (Pch) 28 is turned OFF even if the MOSFET (Nch) 35 is switched, thus making it possible to suppress the generation of heat in the device. If saving of cost is taken into consideration, it may be advisable to employ a clamp Zener diode-attached IPD 15 as shown in FIG. 9 instead of singly employing the Zener diode 31, thereby making it possible to suppress the manufacturing cost.

In the case of the circuit configuration as described above, it is impossible to protect the circuit when the solenoid coils 30, 36 are brought into short-circuiting with the GND. However, when the opposite ends of solenoid coils 30, 36 are brought into short-circuiting due to harness, it is possible to detect the abnormality of electric current by changing the MOSFETs (Nch) 35, 42 into an over-current protection function-attached (Pch) IPD. Further, although it may become more expensive, a current-detecting circuit may be additionally attached to the aforementioned circuit configuration without changing the MOSFETs (Pch) 35, 42 into the IPD, thereby making it possible to detect the abnormality of electric current and also to improve the accuracy of electric current flowing into the solenoid coils.

EXAMPLE 4

Figure 10:
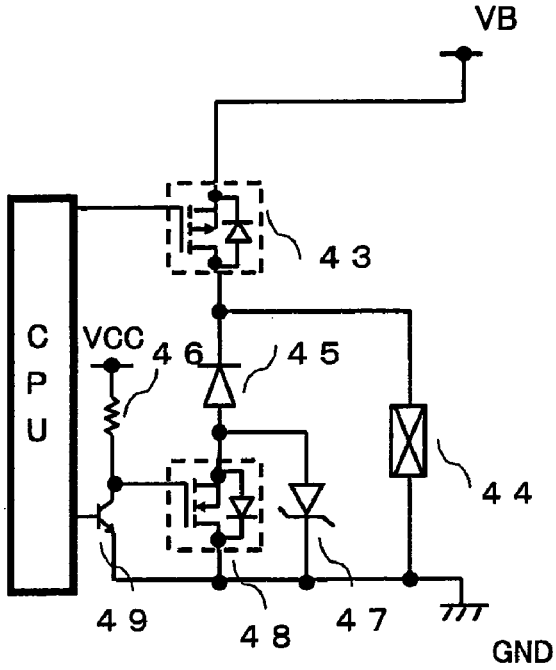
FIG. 10 is a diagram illustrating a circuit configuration of a high-pressure fuel pump drive circuit for engine according to Example 4.

FIG. 10 illustrates a circuit configuration of a high-pressure fuel pump drive circuit for engine according to Example 4.

In this circuit, the solenoid 44 of high-pressure pump is connected with the drain of switching MOSFET (Pch) 43, and the cathode of flywheel diode 45 is connected with the drain of switching MOSFET (Pch) 43 and the anode of flywheel diode 45 is connected with the source of MOSFET (Nch) 48. Further, the anode of Zener diode 47 is connected with the anode of flywheel diode 45 and the cathode thereof is connected with the GND. The MOSFET (Nch) 48 is connected, in parallel, with the Zener diode.

When an input voltage is impressed to the MOSFET (Pch) 43 and the MOSFET (Nch) 48, not only the MOSFET (Pch) 43 but also the MOSFET (Nch) 48 is turned ON, permitting an electric current IL to flow into the solenoid coil 44. At this moment, the drain voltage VD of MOSFET (Pch) 43 is caused to fall from the source voltage VB to about zero volt and, at the same time, the electric current IL flowing through the solenoid coil 44 is caused to rise transiently and electromagnetic energy is caused to accumulate in the solenoid coil 44 due to this electric current IL. When the gate voltage of the MOSFET (Pch) 43 is dropped to 0 volt, the MOSFET (Pch) 43 is turned ON, so that a power to force electric current to flow in the direction to inhibit any changes of magnetic flux is acted thereon due to the self-induction electromotive force ($e=L*\Delta I/\Delta t$) by the electromagnetic energy. As a result, the electric potential of VD is caused to rise, whereby large voltages, opposite in direction, are imposed on the opposite ends of the solenoid coil 44, respectively. These large voltages developed on the opposite ends of the solenoid coil 44 can be vanished by passing electric current to the flywheel diode 45 which is connected, in parallel, with the solenoid coil 44.

Meanwhile, in a steady state wherein the MOSFET (Pch) 43 is turned ON and an input signal as indicated by the number 5 in FIG. 2 is given thereto, since the time for shifting the MOSFET (Pch) 43 from OFF to ON can be made shorter as the switching cycle is made faster, the magnitude of voltage to be developed at the opposite ends of solenoid coil 44 can be confined to a small value and, at the same time, the magnitude of energy to be consumed by the flywheel diode 45 can be minimized, thereby making it possible to minimize the generation of heat in the device.

Figure 11:
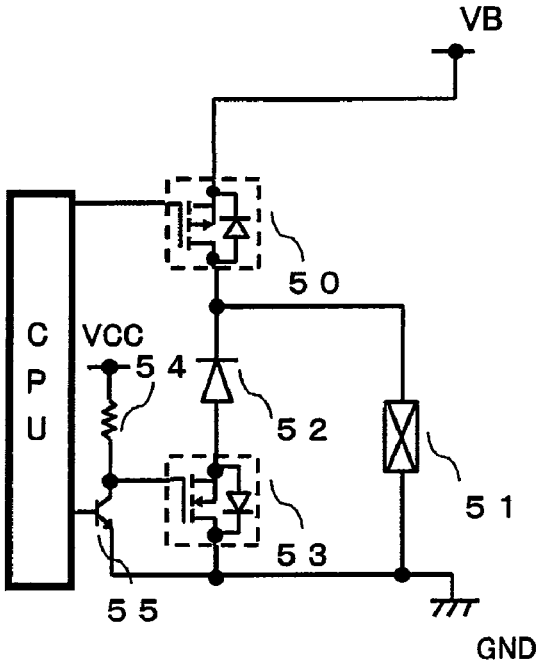
FIG. 11 is a diagram illustrating a circuit configuration modified of the high-pressure fuel pump drive circuit for engine according to Example 4.

When the MOSFET (Pch) 43 is turned OFF concurrent with the switching of the switching MOSFET (Nch) 48 to OFF in order to accelerate the fall time of electric current, a power to force electric current to flow in the direction to inhibit any changes of magnetic flux is acted thereon due to the self-induction electromotive force ($e=L*\Delta I/\Delta t$) by the electromagnetic energy, whereby the electric potential of VD is caused to rise, thus imposing a large voltage on the opposite ends of Zener diode 47. This large voltage developed on the opposite ends of Zener diode 47 cannot be consumed by the flywheel diode 45 due to the existence of the Zener diode but can be completely consumed by the Zener diode. Because of this, it is possible to further shorten the fall time of electric current as compared with the conventional circuit configuration shown in FIG. 1. Furthermore, in contrast to the circuit of FIG. 3, the consumption of energy by the Zener diode 47 cannot be executed unless the switching MOSFET (Nch) 48 is turned OFF even if the MOSFET (Pch) 43 is switched, thus making it possible to suppress the generation of heat in the device. If saving of cost is taken into consideration, it may be advisable to employ a clamp Zener diode-attached IPD 53 as shown in FIG. 11 instead of singly employing the Zener diode 47, thereby making it possible to suppress the manufacturing cost.

In the case of the circuit configuration as described above, it is impossible to protect the circuit when the solenoid coils 44, 51 are brought into short-circuiting with VB. However, when the opposite ends of solenoid coils 44, 51 are brought into short-circuiting due to harness, it is possible to detect the abnormality of electric current by changing the MOSFETs (Pch) 43, 50 into an over-current protection function-attached (Pch) IPD. Further, although it may become more expensive, a current-detecting circuit may be additionally attached to the aforementioned circuit configuration without changing the MOSFETs (Pch) 43, 50 into the IPD, thereby making it possible to detect the abnormality of electric current and also to improve the accuracy of electric current flowing into the solenoid coils 44, 51.

EXAMPLE 5

Figure 12:
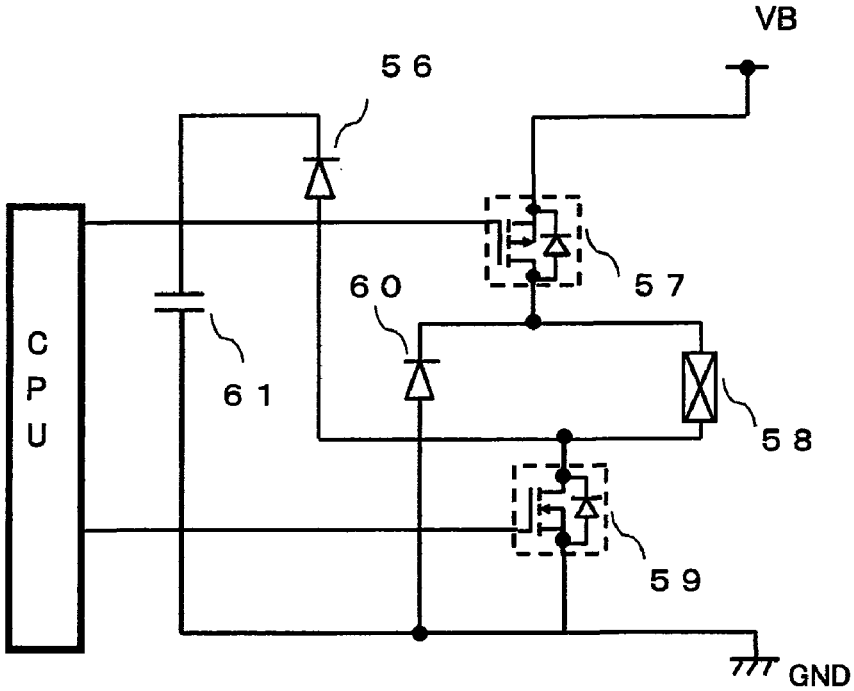
FIG. 12 is a diagram illustrating a circuit configuration of a high-pressure fuel pump drive circuit for engine according to Example 5.

FIG. 12 illustrates a circuit configuration of a high-pressure fuel pump drive circuit for engine according to Example 5.

In this circuit, the solenoid 58 of high-pressure pump is connected with the drain of switching MOSFET (Pch) 57, and the cathode of flywheel diode 60 is connected with the drain of switching MOSFET (Pch) 57 and the anode of flywheel diode 60 is connected with the GND. This circuit differs from that of Example 2 in that instead of connecting the Zener diode with the circuit, an MOSFET (Nch) 59 is employed in such a manner that the drain of the MOSFET (Nch) 59 is connected, in series, with a diode 56 and a booster electrolytic capacitor 61.

When an input voltage is impressed to the MOSFET (Nch) 59 and the MOSFET (Pch) 57, not only the MOSFET (Nch) 59 but also the MOSFET (Pch) 57 is turned ON, permitting an electric current IL to flow into the solenoid coil 58. At this moment, the drain voltage VD of MOSFET (Pch) 57 is caused to fall from the source voltage VB to about zero volt and, at the same time, the electric current IL flowing through the solenoid coil 58 is caused to rise transiently and electromagnetic energy is caused to accumulate in the solenoid coil due to this electric current IL.

When the gate voltage of the MOSFET (Pch) 57 is dropped to 0 volt, the MOSFET (Pch) 57 is turned ON, so that a power to force electric current to flow in the direction to inhibit any changes of magnetic flux is acted thereon due to the self-induction electromotive force ($e=L*\Delta I/\Delta t$) by the electromagnetic energy. As a result, the electric potential of VD is caused to rise, whereby large voltages, opposite in direction, are imposed on the opposite ends of the solenoid coil 58, respectively. These large voltages developed on the opposite ends of the solenoid coil 58 can be vanished by passing electric current to the flywheel diode 60 which is connected, in parallel, with the solenoid coil 58.

Meanwhile, in a steady state wherein the MOSFET (Pch) 57 is turned ON and an input voltage as indicated by the number 5 in FIG. 2 is given thereto, since the time for shifting the MOSFET (Nch) 57 from OFF to ON can be made shorter as the switching cycle is made faster, the magnitude of voltage to be developed at the opposite ends of solenoid coil 58 can be confined to a small value and, at the same time, the magnitude of energy to be consumed by the flywheel diode 60 can be minimized, thereby making it possible to minimize the generation of heat in the device.

When the MOSFET (Nch) 59 is turned OFF concurrent with the switching of the switching MOSFET (Pch) 57 to OFF in order to accelerate the fall time of electric current, the gate voltage of not only the MOSFET (Pch) 57 but also of the MOSFET (Nch) 59 is caused to fall down to zero volt, so that a power to force electric current to flow in the direction to inhibit any changes of magnetic flux is acted thereon due to the self-induction electromotive force ($e=L*\Delta I/\Delta t$) by the electromagnetic energy, whereby the electric potential of VD is caused to rise. This increased electric potential can be turned back to the booster electrolytic capacitor 61, thereby making it possible to shorten the fall time of electric current. Furthermore, in contrast to the circuit of FIG. 3, the generation of heat in the device can be suppressed due to the unemployment of the Zener diode.

Due to the circuit configuration as described above, even if the solenoid coil 58 is brought into short-circuiting with VB, it is possible to protect the circuit by the switching of the MOSFET (Nch) 59 OFF. Further, even if the solenoid coil 58 is brought into short-circuiting with GND, it is possible to protect the circuit by the switching of the MOSFET (Pch) 57 OFF. Further, when the opposite ends of solenoid coil 58 is brought into short-circuiting due to harness, it is possible to detect the abnormality of electric current by changing the MOSFET (Pch) 57 into an over-current protection function-attached (Pch) IPD. Further, although it may become more expensive, a current-detecting circuit may be additionally attached to the aforementioned circuit configuration without changing the MOSFET (Pch) 57 into the IPD, thereby making it possible to detect the abnormality of electric current and also to improve the accuracy of electric current flowing into the solenoid coil.

The present invention is applicable not only to a high-pressure pump for engine but also to any kind of actuators which can be driven through the utilization of magnetic force to be derived from electric current applied to the solenoid coil and where the fall time of inflow current is desired to be shortened.

The invention claimed is:

1. A high-pressure fuel pump drive circuit comprising:

a first switching element and a second switching element configured to manipulate an electric current to be passed to a solenoid coil configured to control a fuel discharge amount of a high-pressure fuel supply pump;

a flywheel diode configured to consume a counter electromotive force that occurs at both ends of the solenoid coil when the first switching element is ON and the second switching element changes from ON to OFF; and a diode configured to consume a portion of a remainder of the counter electromotive force when the first switching element is also turned off, wherein the first switching element, the solenoid coil and the second switching element are connected in series in a route from a source voltage side to a ground side;

the flywheel diode for passing an electric current to a power source is disposed in parallel with the solenoid and with the first switching element;

a Zener diode as the diode is disposed in parallel with the second switching element so as to pass the electric current to the power source; and a feedback circuit comprising the solenoid coil, the flywheel diode and the Zener diode is formed when the second switching element is turned OFF and the first switching element is also turned OFF.

2. The high-pressure fuel pump drive circuit according to claim 1, wherein the Zener diode is omitted and the first switching element is formed of a clamp Zener diode-attached IPD.

3. The high-pressure fuel pump drive circuit according to claim 1, wherein the first switching element is additionally provided with a current-detecting circuit.

4. A high-pressure fuel pump drive circuit comprising:

a first switching element and a second switching element configured to manipulate an electric current to be passed to a solenoid coil configured to control a fuel discharge amount of a high-pressure fuel supply pump;

a flywheel diode configured to consume a counter electromotive force that occurs at both ends of the solenoid coil when the first switching element is ON and the second switching element changes from ON to OFF; and a diode configured to consume a portion of a remainder of the counter electromotive force when the first switching element is also turned off, wherein the first switching element, the solenoid coil and the second switching element are connected in series in a route from a source voltage side to a ground side;

the flywheel diode for passing an electric current to the first switching element from the ground is disposed in parallel with the second switching element and with the solenoid;

a Zener diode as the diode connecting the ground with the solenoid is disposed in parallel with the second switching element; and a feedback circuit comprising the solenoid coil, the Zener diode and the flywheel diode is formed when the first switching element is turned OFF and the second switching element is also turned OFF.

5. The high-pressure fuel pump drive circuit according to claim 4, wherein the Zener diode is omitted and the second switching element is formed of a clamp Zener diode-attached IPD.

6. The high-pressure fuel pump drive circuit according to claim 4, wherein the second switching element is additionally provided with a current-detecting circuit.

7. A high-pressure fuel pump drive circuit comprising:

a first switching element and a second switching element configured to manipulate an electric current to be passed to a solenoid coil configured to control a fuel discharge amount of a high-pressure fuel supply pump;

a flywheel diode configured to consume a counter electromotive force that occurs at both ends of the solenoid coil when the first switching element is ON and the second switching element changes from ON to OFF; and a diode configured to consume a portion of a remainder of the counter electromotive force when the first switching element is also turned off, wherein the solenoid coil and the second switching element are connected in series in a route from a source voltage side to a ground side;

the flywheel diode and the first switching element are disposed in series with each other and in parallel with the solenoid coil so as to pass an electric current to a power source;

a Zener diode as the diode is disposed in parallel with the first switching element so as to pass the electric current to the power source; and a feedback circuit comprising the solenoid coil, the flywheel diode and the Zener diode is formed when the second switching element is turned OFF and the first switching element is also turned OFF.

8. The high-pressure fuel pump drive circuit according to claim 7, wherein the Zener diode is omitted and the first switching element is formed of a clamp Zener diode-attached IPD.

9. The high-pressure fuel pump drive circuit according to claim 7, wherein the first switching element is additionally provided with a current-detecting circuit.

10. A high-pressure fuel pump drive circuit comprising:

a first switching element and a second switching element configured to manipulate an electric current to be passed to a solenoid coil configured to control a fuel discharge amount of a high-pressure fuel supply pump;

a flywheel diode configured to consume a counter electromotive force that occurs at both ends of the solenoid coil when the first switching element is ON and the second switching element changes from ON to OFF; and a diode configured to consume a portion of a remainder of the counter electromotive force when the first switching element is also turned off, wherein the first switching element and the solenoid coil are connected in series in a route from a source voltage side to a ground side;

the second switching element for an electric current from the ground side to the first switching element and the flywheel diode are disposed in series with each other and in parallel with the solenoid;

a Zener diode as the diode connecting the ground with the flywheel diode is disposed in parallel with the second switching element; and a feedback circuit comprising the solenoid coil, the Zener diode and the flywheel diode is formed when the first switching element is turned OFF and the second switching element is also turned OFF.

11. The high-pressure fuel pump drive circuit according to claim 10, wherein the Zener diode is omitted and the second switching element is formed of a clamp Zener diode-attached IPD.

12. The high-pressure fuel pump drive circuit according to claim 10, wherein the second switching element is additionally provided with a current-detecting circuit.

13. A high-pressure fuel pump drive circuit comprising:

a first switching element and a second switching element configured to manipulate an electric current to be passed to a solenoid coil configured to control a fuel discharge amount of a high-pressure fuel supply pump;

a flywheel diode configured to consume a counter electromotive force that occurs at both ends of the solenoid coil when the first switching element is ON and the second switching element changes from ON to OFF; and a diode configured to consume a portion of a remainder of the counter electromotive force when the first switching element is also turned off, wherein the first switching element, the solenoid coil and the second switching element are connected in series in a route from a source voltage side to a ground side;

the flywheel diode is connected in parallel with the solenoid and with the second switching element so as to pass an electric current from the ground side;

a booster electrolytic capacitor is connected so as to pass the electric current from the second switching element side of the solenoid coil via the diode; and a feedback circuit comprising the solenoid coil, the diode, the booster electrolytic capacitor and the flywheel diode is formed when the first switching element is turned OFF and the second switching element is also turned OFF.

14. The high-pressure fuel pump drive circuit according to claim 13, wherein the first switching element is formed of an over-current protection function-attached (Nch) IPD or is additionally provided with a current-detecting circuit.

* * * * *